US005810044A

United States Patent [19]

Saidi

[11] Patent Number: 5,810,044

[45] Date of Patent: Sep. 22, 1998

[54] FLUID CONTROL SYSTEM

[76] Inventor: Namat L. Saidi, 6509 W. 6th St., Los Angeles, Calif. 90048

[21] Appl. No.: 751,076

[22] Filed: Nov. 15, 1996

[51] Int. Cl.[6] ..... E03B 9/02

[52] U.S. Cl. ..... 137/272; 137/296; 137/801; 137/802

[58] Field of Search ..... 137/272, 296, 137/312, 403, 800, 801, 802; 222/527; 239/589, 602, DIG. 12; 220/315

[56] References Cited

U.S. PATENT DOCUMENTS

| | | | |
|---|---|---|---|
| 3,137,419 | 6/1964 | Davy | 222/527 |
| 3,363,640 | 1/1968 | Gallo, Sr. | 137/272 |

FOREIGN PATENT DOCUMENTS

| | | | |
|---|---|---|---|
| 668268 | 11/1938 | Germany | 137/272 |

*Primary Examiner*—George L. Walton

*Attorney, Agent, or Firm*—Merchant, Gould, Smith, Edell, Welter & Schmidt

[57] ABSTRACT

A system for controlling fluid flow from an outlet aperture, particularly a standpipe such as a fire hydrant. There is a first cylindrical collar element for location around the standpipe and connected with that element a second cylindrical element such that a space is defined between the two elements. There is a base provided between the two elements and a first outlet pipe for location above the standpipe. When the system is located about the standpipe fluid fills the space and stabilizes the elements relative to the standpipe. Fluid can then be directed away from the area of the aperture in the standpipe through the flexible pipe.

20 Claims, 1 Drawing Sheet

FLUID CONTROL SYSTEM

BACKGROUND

Controlling the unregulated flow of fluid from fire hydrants or gushers such as oil wells is valuable.

This invention is directed to controlling the unregulated flow of water from fire hydrants, or bursts in pipes or gushers supplying other fluids such as oil, water or chemicals.

When a fire hydrant inadvertently breaks a seal or is knocked over by a vehicle, water can flow uncontrollably under high pressure from the hydrant or an aperture in the piping leading to the hydrant. There is a need to have a simple system for controlling the flow from that uncontrolled source.

In other situations, there can be uncontrolled flow of chemical spills. There can be an outlet or an aperture in the system which needs to be stopped.

In an oil field, there can be uncontrolled flow from a well head and there is a need for a system for controlling such flow.

There is a need to provide a system for relatively easy use, particularly in emergency situations to control unregulated flow from apertures.

SUMMARY

By this invention there is provided a system for controlling unregulated flow in a manner which is easily usable and which can be relatively portable as required for emergency situations.

According to the invention, a system for controlling fluid flow from an outlet aperture comprises at least two concentric collar elements with a space between them. A base is located at one end of the collar elements and joins the two elements together. An outlet is provided from the space and this is connected to a flexible pipe for directing fluid flow from the space to a selected location.

In use, the two elements are draped about an outlet aperture so that fluid flow from the outlet aperture fills the space. The mass of fluid in the space causes the elements to seat about the aperture. Thereafter fluid from the aperture is permitted to pass out of the space through the flexible pipe.

The invention is further described with reference to the accompanying drawings.

DRAWINGS

DESCRIPTION

Figure 1:
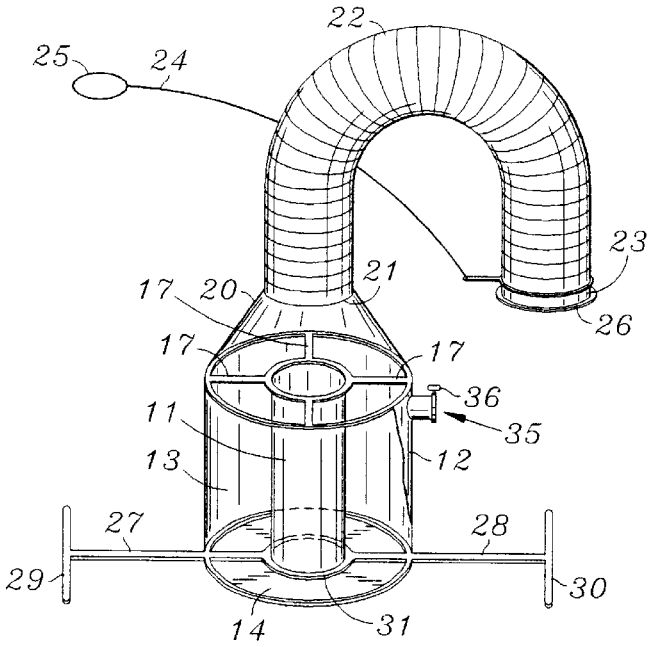
FIG. 1 is a perspective view illustrating the two elements in relationship to each other together with a space between them and a flexible pipe connected with that space.

A system is provided for controlling fluid flow from an outlet aperture 10. The outlet aperture 10 could be the top of a standpipe of a fire hydrant, or any other portion of a fire hydrant.

In other situations, the aperture may be an outlet nozzle from a pipe conveying chemicals in a fluid state in the nature of solid particles or liquids. In yet other situations, the outlet aperture 10 could be the outlet port from an oil gusher, well head or other fluid outlet port where there is usually considerable pressure in the outlet aperture for propelling the fluid from the aperture.

The aperture 10 can also be one which is intentionally present and which is intentionally needs to be vented. There is a need to redirect flow from that outlet aperture 10 to some other location or it could be an aperture caused accidentally or by an act of nature and from which the fluid flow needs to be controlled.

There are at least two concentric elements, a first element 11 for being fairly or relatively more closely located about the aperture 10. This element 11 forms a wall about that aperture into which fluid can flow.

Around the first element 11 there is a second concentric element 12. Between the two elements 11 and 12 there is a concentric space 13. This space 13 is essentially in the shape of a donut formed between the concentric wall 11 and the concentric wall 12.

At the base area of each of the walls 11 and 12 there is a joint formed by a foundation or base element 14. This base 14 connects the end of the elements 11 and 12 together towards that one end, thereby to form a chamber for fluid. At the opposite end 15 and 16, respectively, of elements 11 and 12 there are radial struts 17 which act to keep the two elements 11 and 12 spaced apart. The struts 17 help ensure the integrity of the space 13 between the two elements 11 and 12. The struts are four pieces of canvas or other flexible material. In some cases the material of the struts can be rigid.

Above the elements 11 and 12, namely above the ends 15 and 16, there is a space 18 which is essentially coned shape with a decreasing diameter 19. The decreasing diameter of the wall forming the cone-shaped element 20 is connected with the end 16 of the wall 12, and acts as a reducer from the space between the elements and the outlet 10.

The top of the cone element 20 is truncated so that a second outlet 21 is formed at the end of that cone 20. The second outlet 21 is connected with a pipe 22.

The pipe 22 is a flexible hose element which can be of an appropriate length. Towards the end 23 of the hose element 22 there is provided a cord or rope 24 with a handle 25. By means of this rope 24 and handle 25 the third outlet end 23 from the flexible pipe 22 can be directed to any suitable location. A user can manipulate the end 23 of the hose as necessary. There is also provided an adapter 26 at the third outlet end 23 so as to permit the end of the hose 23 to be connected to some other pipe or conduit as necessary.

Around the base 14 there are provided two handle spoke elements 27 and 28, each with a handle member 29 and 30, respectively. In use, operators would be able to lift the unit as constituted by the elements, the space between the elements and the connected flexible pipe to a position over an aperture 22. The spokes 27 and 28 are connected through a ring or connecting member 31 about the element 11 so as to permit handling of the unit.

When a situation arises that it is necessary to tap off the fluid supply from the aperture 10, the device is taken and located in position. Fluid from the aperture 10 flows in the inside of the first cylindrical element 11 as indicated by arrow 32. The first fluid then falls into the space 13 between the first element 11 and second element 12 as indicated by arrows 33. The weight or mass of the fluid in the space 13 acts to seat or locate the elements relatively firmly in position about the aperture 10.

As the space 13 fills so the device is more securely located in position about the aperture 10. When the space 13 has filled up to the top of the device as defined by the ends 15 and 16, the conical portion 18 is filled. The fluid flow continues as indicated by arrows 33 up the flexible pipe 22.

Figure 2:
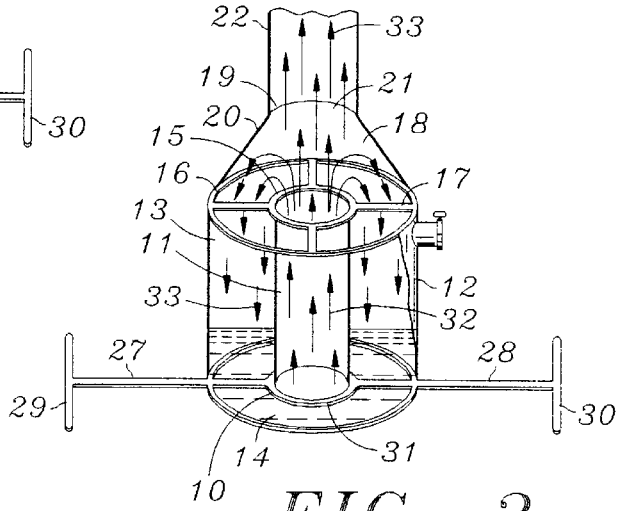
FIG. 2 is a perspective view of a device having the two elements showing fluid passing into the device from the outlet aperture and filling the space and thereafter being directed into the outlet pipe.
Figure 3:
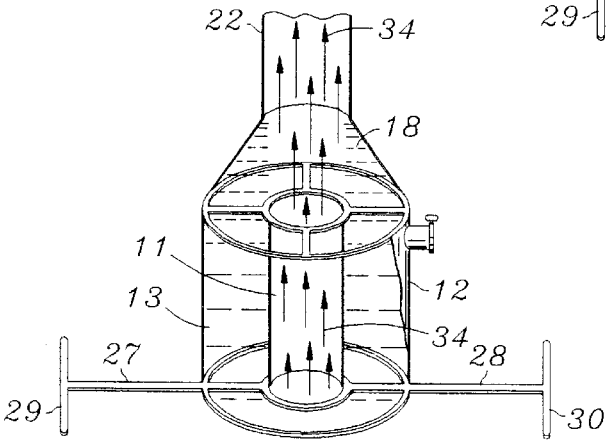
FIG. 3 is a perspective view illustrating the device about the outlet aperture with the space filled with fluid and water flowing from the outlet aperture through the pipe.

As illustrated in FIG. 3 the fluid flow is only directed according to arrows 34 up the central element 34 and out of the pipe 22. The fluid in the space 13 is relatively stationary since it has been filled up in stage 1 as illustrated in FIG. 2. Some of the fluid in the section 18 may be stationary while other parts of that fluid may flow up through the pipe 22.

As illustrated in FIG. 1, there is provided a fourth aperture 35 in the outside cylindrical wall 12 of the device. There is also provided a valve 36 with that fourth aperture outlet port 35 so that the flow from that port can be selectively directed as required. The outlet port 35 may include another adapter so it can be connected to another pipe to control fluid flow.

In a typical situation as anticipated for use by an emergency fire department for controlling fire hydrant flow, the diameter between handles 29 and 30 will be about 7 feet, the diameter of the outside element 12 about 33 inches, the inside element 11 about 9 inches. The height of the first and second elements 11 and 12 between the base 14 and the ends 15 and 16 will be about 2 foot, and the height between the base 14 and the position of the outlet 21 would be about 3 foot. The diameter of the aperture 21 would be about 9 inches and a flexible pipe would have a length of about 4 foot and the cord 24 would be about 10 foot long to control the position of the end of the flexible pipe.

Many other forms of the invention exist each differing from the other in matters of detail only.

Although the device has been described with reference to controlling flow out of a hydrant, there could be many other applications as indicated. There could be situations for use where regulated control out of a horizontally directed or other non-vertically directed aperture needs to be controlled.

In uses where the first aperture is substantially larger, for instance the head of a well or the like, the device itself may be proportionately very much larger. Where the pressure from the outlet is substantially higher, the device also could be significantly larger.

Although the unit has been defined as an integrated cylindrical member for location about the aperture, there could be situations where the device is articulated about one or more joints along its longitudinal length. Thus, the device could be formed in sections to be folded and formed around the aperture in a collar format in different stages. This could be a situation where it is typical to approach the aperture easily through the handle technique and applying the device to the aperture in that manner. Different constructions can be applied to permit the hinge or articulated approach whereby the elements are put together in a manner to progressively envelop the aperture 10.

In similar situations, it may be useful to have more than two cylindrical elements in spaced relationship. This can be to improve the integrity of the device and to also facilitate positioning of the device relative to the aperture 10. Although the device has been described as cylindrical elements, there could be situations where the cylindrical elements form a different shape of collar to circumscribe the aperture 10.

The invention is to be determined solely in terms of the following claims.

I claim:

1. A system for controlling the flow of fluid from an first outlet aperture comprising:

a first element for surrounding the aperture;

a second element for surrounding the first element such that there is a space between the two elements, each of the elements having a selected predetermined length;

a second outlet connecting with the space between the two elements for directing fluid flow from the space to a third outlet; and a connection between the first and the second elements such that the space is arranged to collect an overflow of fluid from the first aperture and thereby seat and secure the first element and second element about the first aperture, the seating being affected at least partly due to the mass of the fluid collected within the space, wherein the collected fluid is able to be controllably directed from the space and through the third outlet.

2. A system as claimed in claim 1 including a flexible pipe for connection between the second outlet and the third outlet for directing the outflow from the second outlet to a selected location.

3. A system as claimed in claim 2 including at least one flexible cord for facilitating directing the location of the flexible pipe, the cord being capable of being manipulated.

4. A system as claimed in claim 1 wherein the surrounding elements are collars, the collars being connected by struts directed between them.

5. A system as claimed in claim 4 wherein the second element includes a fourth outlet and valve, the fourth outlet being for selectively directing fluid from the space and for controlling fluid in the space between the first element and the second element.

6. A system as claimed in claim 4 wherein the collars are substantially cylindrical, and wherein the struts are radially directed between the collars, the struts being located towards the end removed from the base.

7. A system as claimed in claim 1 including a handle directed from the elements to facilitate locating the elements about the first aperture.

8. A system as claimed in claim 7 wherein the handle is radially directed from the elements to permit locating the elements about the first aperture.

9. A system as claimed in claim 7 wherein the handle means for locating the elements about the aperture is radially connected substantially at a position adjacent to a base for the two elements.

10. A system as claimed in claim 1 wherein the first aperture is located in a standpipe, the standpipe being directed substantially vertically.

11. A system as claimed in claim 1 wherein the second element includes a fourth outlet and valve, the fourth outlet and valve being for directing fluid selectively from the space.

12. A system as claimed in claim 1 including a base between the first element and the second element for permitting the collection of fluid on the base and between the first element and the second element, such first element and second element acting as walls connected with the base thereby to form a fluid chamber.

13. A system for controlling the flow of fluid from an first outlet aperture comprising:

a first cylindrical element for surrounding the aperture;

a second cylindrical element for surrounding the first cylindrical element such that there is a space between the two elements, each of the elements having a selected predetermined length;

a second outlet connecting with the space between the two cylindrical elements for directing fluid flow from the space to a third outlet;

a base connection between the first and the second elements such that the space is a chamber for collecting an overflow of fluid from the first aperture and thereby seat and secure the first element and second element about the first aperture, the seating being affected at least partly due to the mass of the fluid collected within the space, wherein the collected fluid is able to be controllably directed from the space and through the third outlet; and the second outlet being formed towards the end of the end elements in a position removed from the base.

14. A system as claimed in claim 13 including a conical member for location at the second outlet for directing fluid from the chamber to the second outlet.

15. A system as claimed in claim 14 including a flexible pipe for connection between the second outlet and the third outlet for directing the outflow from the second outlet to a selected location.

16. A system for controlling the flow of fluid from an first outlet aperture comprising:

a first element for surrounding the aperture;

a second element for surrounding the first cylindrical element such that there is a space between the two elements, each of the elements having a selected predetermined length;

a second outlet connecting with the space between the two cylindrical elements for directing fluid flow from the space to a third outlet;

a base connection between the first and the second elements such that the space is a chamber for collecting an overflow of fluid from the first aperture and thereby seat and secure the first element and second element about the first aperture, the seating being affected at least partly due to the mass of the fluid collected within the space, wherein the collected fluid is able to be controllably directed from the space and through the third outlet;

the second outlet being formed towards the end of the end elements in a position removed from the base; and a reducing member for location at the second outlet for directing fluid from the chamber to the second outlet.

17. A system as claimed in claim 16 including a flexible pipe for connection between the second outlet and the third outlet for directing the outflow from the second outlet to a selected location.

18. A system as claimed in claim 16 including a handle directed from the elements to facilitate locating the elements about the first aperture, the handle being radially directed from the elements to permit locating the elements about the first aperture.

19. A system as claimed in claim 18 wherein the handle means for locating the elements about the aperture is radially connected substantially at a position adjacent to a base for the two elements.

20. A system as claimed in claim 17 including a handle directed from the elements to facilitate locating the elements about the first aperture, the handle being radially directed from the elements to permit locating the elements about the first aperture.

* * * * *